US006439485B1

(12) United States Patent
Börner

(10) Patent No.: US 6,439,485 B1
(45) Date of Patent: Aug. 27, 2002

(54) ROTARY SPRAY ATOMIZER

(75) Inventor: Gunter Börner, Mülhausen (DE)

(73) Assignee: ABB Patent GmbH, Ladenburg (DE)

( * ) Notice: Subject to any disclaimer, the term of this patent is extended or adjusted under 35 U.S.C. 154(b) by 0 days.

(21) Appl. No.: 09/655,283

(22) Filed: Sep. 5, 2000

Related U.S. Application Data

(63) Continuation of application No. PCT/EP98/01217, filed on Mar. 4, 1998.

(51) Int. Cl.[7] ..... B05B 5/00
(52) U.S. Cl. ..... 239/706; 239/700; 239/703
(58) Field of Search ..... 239/700–707

(56) References Cited

U.S. PATENT DOCUMENTS 2,784,114 A * 3/1957 Miller ..... 239/3
3,393,662 A * 7/1968 Blackwell ..... 239/706
4,682,735 A * 7/1987 Mommsen ..... 239/690
4,771,949 A * 9/1988 Behr et al. ..... 239/703
4,872,616 A * 10/1989 Behr et al. ..... 239/703
4,887,770 A * 12/1989 Wacker et al. ..... 239/703
4,995,560 A * 2/1991 Lasley et al. ..... 239/708
5,011,086 A * 4/1991 Sonnleitner et al. ..... 239/691
5,775,598 A * 7/1998 Takayama et al. ..... 239/703

* cited by examiner

*Primary Examiner*—Henry C. Yuen
*Assistant Examiner*—Dinh Q. Nguyen
(74) *Attorney, Agent, or Firm*—Laurence A. Greenberg; Werner H. Stemer; Ralph E. Locher

(57) ABSTRACT

A rotary spray atomizer for applying electrically conductive paint, in particular water-based paint, to surfaces, includes a housing. A spray head is fitted on front of the housing for receiving a supply of paint and discharging the supply of paint in a spray mist as a result of rotation. A motor is disposed in the housing for rotary actuation of the spray head. At least two electrode holders are disposed along a concentric circle and extend towards the front parallel to a longitudinal axis of the housing. Electrodes are each accommodated in and protrude from an end of a respective one of the electrode holders. High-voltage sources constructed as a cascade are each plugged into a respective one of the electrode holders for receiving a low-voltage current, feeding one of the electrodes and causing the electrode to generate an electric field applying the spray mist discharged by the spray head to an application surface.

10 Claims, 2 Drawing Sheets

ROTARY SPRAY ATOMIZER

CROSS-REFERENCE TO RELATED APPLICATION

This application is a continuation of copending International Application No. PCT/EP98/01217, filed Mar. 4, 1998, which designated the United States.

BACKGROUND OF THE INVENTION

Field of the Invention

The invention relates to a rotary spray atomizer for applying electrically conductive paint, in particular water-based paint, to surfaces, including a housing, a drive motor disposed in the housing for rotary actuation of a spray head fitted on the front, receiving a supply of paint and discharging the supplied paint in a spray mist as a result of rotation, and at least two concentrically disposed electrodes extended parallel to a longitudinal axis of the housing towards the front, accommodated in electrode holders, fed by at least one high-voltage source and generating an electric field applying the spray mist discharged by the spray head to an application surface.

Rotary spray atomizers have long been generally known in the prior art for electrostatic coating with electrically conducting paint (German Patent DE 31 30 096 C2 or German Patent DE 31 51 929 C2). In the case of such a device, the paint to be applied is supplied to a rotatably mounted spray head which is driven by a motor, preferably by a motor operated with compressed air, and propelled away as a result of the rotationally induced centrifugal force. That involves using an electric field which is generated all around the grounded spray head with the aid of concentrically disposed point electrodes supplied from a common high-voltage source.

In that case, the paint droplets being propelled away are charged in the electric field which forms between the high-voltage electrodes and the grounded spray head by ions that are produced by ionization processes at the point electrodes.

In that case, the surface to be coated is connected to a lower potential, usually ground, so that, as a result of the potential difference induced in that way, the paint particles charged by the electric field are accelerated towards the application surface, where they adhere.

That technique has proven successful and is in widespread use.

The charging principle means that it is technically necessary for parts grounded in the atomizer (spray head, turbine and ground lead) to be electrically insulated from parts carrying high voltage (electrodes, high-voltage lead and device for distribution). That is extremely problematical with the high voltage (up to 100 kV) and the small distances between the parts carrying high voltage, in particular on the back plate. If there is inadequate insulation, a disruptive discharge occurs, which leads to failure of the atomizer.

Since the geometry of the point electrodes is never entirely the same, the field strengths in front of the individual point electrodes and consequently the ionization current are never the same. That brings about a non-uniform charging of the paint droplets around the atomizer and increases the possibility of soiling. That non-uniformity is further intensified during operation by the effects of wear and soiling. The different field strengths at the point electrodes cannot be corrected with the existing technology.

The functional-principle is such that an electric current flows from the spray head to ground. That current may be up to 1000 $\mu$A. If an air-cushioned turbine is used, there is no galvanic connection between the spray head and the ground lead. The current commutates through the air cushion in the turbine. That causes erosion effects, which lead to damage and consequently interruptions in spray operation with the rotary atomizer caused by malfunctions.

In order to partly overcome the problem explained above, it has been proposed to decentralize the high-voltage supply of the electrodes and, instead of a single external high-voltage source which supplies all of the electrodes, to provide a permanently installed separate high voltage source in each electrode. In that way, it is possible to dispense with the high-voltage insulation of the rotary atomizer.

However, whenever there is a malfunction, it is then necessary to exchange the complete electrode unit, that is to say the electrode holder with the electrode, irrespective of which component is damaged. That is neither economical nor environmentally friendly, since in the event of a malfunction being discovered, it is generally the case that only either the electrode or the high-voltage source, or else part of the high-voltage source, but not both main components, which are affected by any damage.

SUMMARY OF THE INVENTION

It is accordingly an object of the invention to provide a rotary spray atomizer, which overcomes the hereinaforementioned disadvantages of the heretofore-known devices of this general type in a simple way.

With the objects of the invention in view, there is also provided a rotary spray atomizer for applying electrically conductive paint, in particular water-based paint, varnish or lacquer, to surfaces, comprising a housing having a front and a longitudinal axis; a spray head fitted on the front of the housing for receiving a supply of paint and discharging the supply of paint in a spray mist as a result of rotation; a drive motor disposed in the housing for rotary actuation of the spray head; at least two electrode holders disposed along a concentric circle, having an end, and extended towards the front parallel to the longitudinal axis of the housing; at least two electrodes each accommodated in and protruding from the end of a respective one of the at least two electrode holders; and at least two high-voltage sources constructed as a cascade and each plugged into a respective one of the at least two electrode holders for receiving a low-voltage current, feeding a respective one of the at least two electrodes and causing the at least two electrodes to generate an electric field applying the spray mist discharged by the spray head to an application surface.

The invention therefore provides that in each electrode holder there is disposed an insertable or plugable cascade as the high-voltage source, which feeds the associated electrode respectively disposed on the front. Consequently, the high voltage is present only at the tip of the electrode holders.

This type of voltage supply achieves the effect that, on one hand, long high-voltage supply lines with a voltage of about 100 kV are avoided and, on the other hand, simple exchanging of the locally disposed high-voltage generator is possible at any time. Operational availability is distinctly improved as a result.

In this case, the voltage supply of the high-voltage source disposed in each electrode holder is provided according to the power demand by a d.c. voltage source of low voltage directly alongside the rotary atomizer, for example a storage battery, or through a low-voltage line. Consequently, the requirement for elaborate high-voltage insulation is restricted to the electrode holder.

In addition, it proves to be advantageous that the housing of the rotary atomizer is insulated in accordance with the protection class for insulated housings known in installation technology. At least certain portions of the retained metallic rotor shaft are used as a conductor for the required grounding. A current flow does not take place through the air gaps in the bearings since the housing is insulated and is accordingly at floating potential, that is to say it does not have any differential potential with respect to the rotor shaft.

In order to discharge possible ground currents, it is sufficient to place a ring of electrically conducting material which encloses the shaft and is connected to a ground conductor, at the rear end of the shaft. The gap width of the annular air gap in this case may be greater than in the case of a shaft bearing, since no current flows there for the reasons explained above.

In accordance with another feature of the invention, the high-voltage source respectively disposed in the electrode holders for feeding the associated electrode is constructed as a cascade including diodes and capacitors, which serves as a voltage amplifier. In addition to the cascade, a transformer and an inverter may also be integrated into the high-voltage source for generating the a.c. voltage required for feeding the cascade from the feeding d.c. voltage (low voltage).

In accordance with a further feature of the invention, there are provided measuring elements for the cascade current and cascade voltage.

In accordance with an added feature of the invention, the electrode holder is advantageously provided with a spring element, which is disposed between the electrode and the cascade. Contact needles, which interact on one hand with the electrode and on the other hand with the cascade, ensure the electrical connection between the cascade and the electrode. As a result of the resilient force being applied, contact stability is increased and at the same time simple exchangeability of the cascade is ensured.

In accordance with an additional feature of the invention, each electrode holder is removable and is connected to the assigned housing connection through the use of a union nut or through the use of a bayonet fastener. Sealing rings are used between the respective electrode holder and the connection for it on the housing of the rotary atomizer to avoid contact problems as a result of moisture or soiling penetrating into the gaps.

In accordance with yet another feature of the invention, there are provided six electrode holders disposed at regular intervals around the housing, the holders having a front end respectively constructed as a tip which receives the associated electrode.

In accordance with yet a further feature of the invention, a radial distance between the housing and an electrode holder may be fixed in such a way that it corresponds at most to the diameter of an electrode holder.

In accordance with yet an added feature of the invention, the length of an electrode holder corresponds to at least five times its diameter.

In accordance with yet an additional feature of the invention, the electrode holders are advantageously disposed on a ring which concentrically surrounds the housing.

In accordance with again another feature of the invention, as an alternative, the electrode holders may in each case also be disposed on holding arms which are attached radially to the housing.

In addition, the basic principle on which the invention is based, of supplying the electrodes individually with high voltage, has the associated effect of permitting each electrode to be separately controlled. Consequently, a uniform charging of the paint droplets is ensured.

Furthermore, failures of an electrode caused by damage or soiling can be quickly detected. Since the construction of the high-voltage supply according to the invention allows simple, if need be permanent, monitoring of the characteristic electrical variables in the low-voltage area, to be specific on the supply line, malfunctions that are occurring are immediately detected and indicated, so that the remedial measures required can be commenced without delay.

In accordance with again a further feature of the invention, each of the high-voltage sources forms a structural unit to be exchanged en bloc together with a respective one of the electrodes.

In accordance with a concomitant feature of the invention, the drive motor is a turbine having a turbine casing at floating potential, and current commutation takes place outside the turbine through electrodes, in particular a ring.

Other features which are considered as characteristic for the invention are set forth in the appended claims.

Although the invention is illustrated and described herein as embodied in a rotary spray atomizer, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
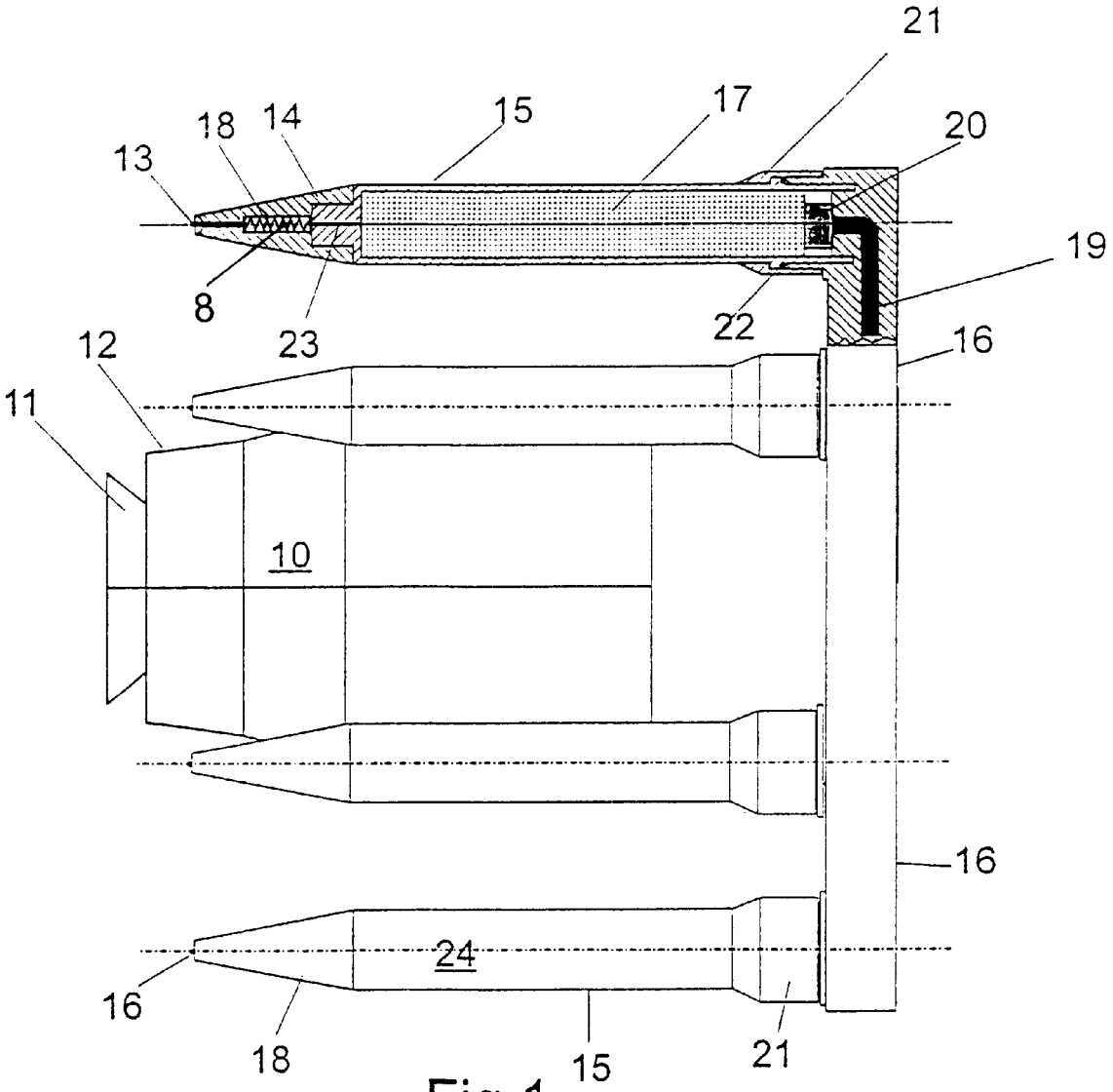
FIG. 1 is a diagrammatic, partly longitudinal-sectional general view of a rotary spray atomizer according to the invention.

Referring now to the figures of the drawings in detail and first, particularly, to FIG. 1 thereof, there is seen a spray atomizer 10 for handling electrically conductive substances to be applied. The spray atomizer 10 has a housing 12 with a spray head 11 fitted on the front and two electrodes 13 disposed diametrically opposite each other and disposed at free ends 18 of electrode holders 24, facing a front side of the housing 12.

The electrode holders 24 are disposed axially parallel to a longitudinal axis of the housing 12 on a ring 16 concentrically adjoining the housing 12 at the rear.

Figure 2:
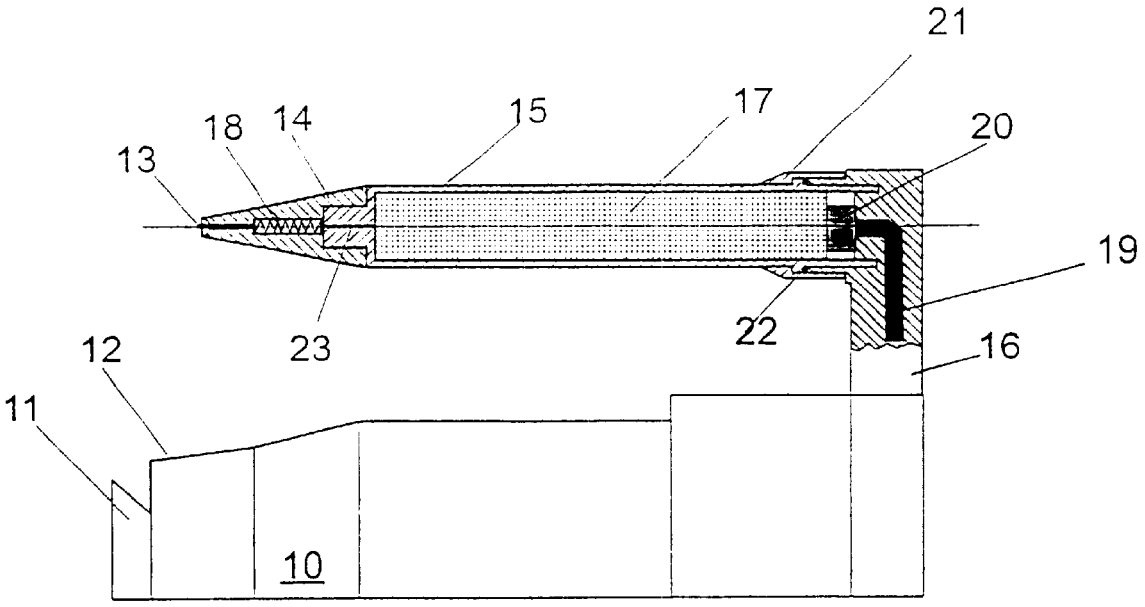
FIG. 2 is a partly longitudinal-sectional view of a rotary atomizer divided along a longitudinal axis, with an electrode holder according to the invention.

As is represented at the top of FIG. 1 and as is similarly shown in a partial longitudinal section in FIG. 2, an electrode holder 24 includes a high-voltage generator 17 which is fixedly accommodated in a housing 15, as well as a receptacle 14 for the electrode 13. A contact pin 23 conducts high voltage from the high-voltage generator 17 to the electrode receptacle 14. Stable contacting with respect to the electrode 13 is ensured through the use of a spring element 8, which is constructed in this case as a helical compression spring.

The high-voltage generator 17 is connected at the ring 16 by a plug-in contact to a low-voltage supply line 19. The electrode receptacle 14 has been screwed onto the housing 15 of the high-voltage generator 17, so that an exchange of the electrode can be carried out without completely changing the electrode holder 24. The high-voltage generator 17 integrated into the housing 15 has been inserted exchangeably into the adjoining ring 16. The high-voltage generator 17 is fastened through the use of a union nut 21 with a thread or with a bayonet fastener. O-rings 22 are disposed between the electrode holder 24 and the concentric ring 16 for sealing.

A non-illustrated monitoring and/or control device may be integrated in the low-voltage supply line 19 so that electrical parameters may be set, monitored and corrected if need be.

Figure 3:
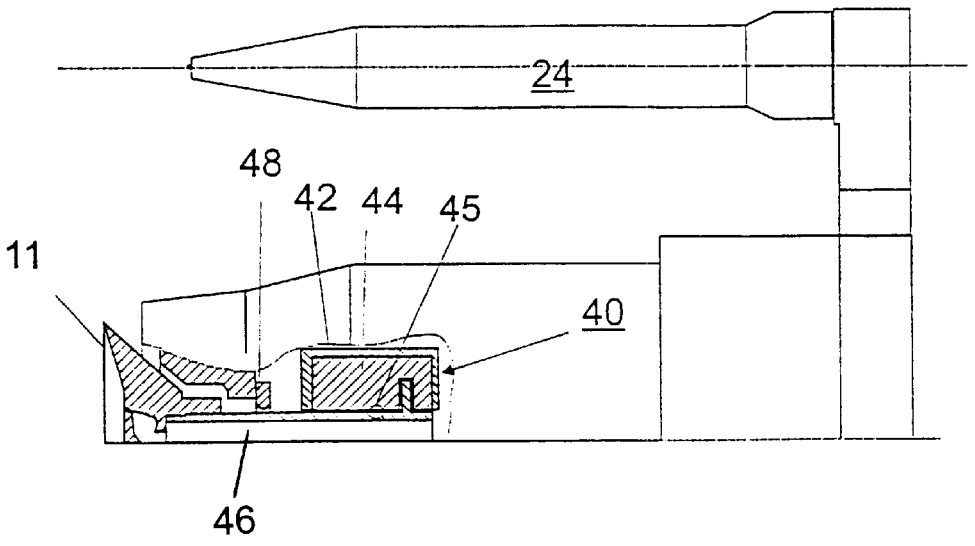
FIG. 3 is a partly longitudinal-sectional view of a rotary atomizer, divided along the longitudinal axis, with an electrode holder.

FIG. 3 is a partial section through the housing, through a drive 40 constructed as a turbine and through the spray head 11.

A drive shaft which is constructed as a metallic hollow shaft 46 is mounted in a turbine casing 44 which is likewise conductive. However, no galvanic connection exists between the shaft 46 and the turbine casing 44 since the two are separated from each other by an air gap 45. The turbine casing 44 is insulated with respect to other parts carrying ground potential by an insulating layer 42. Commutation of the current takes place from the shaft 46 through a grounded ring 48.

Consequently, the turbine casing 44 is at a floating potential and a current flow through the air gap 45 is avoided. In this case, the ring 48 has been produced from a material, for example carbon, which has a low spattering tendency in combination with the material of the shaft 46, which is preferably steel.

I claim:

1. A rotary spray atomizer for applying electrically conductive paint to surfaces, comprising:

a housing having a front and a longitudinal axis;

a spray head fitted on said front of said housing for receiving a supply of paint and discharging the supply of paint in a spray mist as a result of rotation;

a drive motor disposed in said housing for rotary actuation of said spray head;

at least two electrode holders disposed along a concentric circle, having an end, and extended towards said front parallel to said longitudinal axis of said housing;

at least two electrodes each accommodated in and protruding from said end of a respective one of said at least two electrode holders; and at least two cascaded high-voltage sources each built into a respective one of said at least two electrode holders for receiving a low-voltage current, feeding a respective one of said at least two electrodes and causing said at least two electrodes to generate an electric field applying the spray mist discharged by said spray head to an application surface.

2. The spray atomizer according to claim 1, including at least two spring elements each disposed between said cascaded high-voltage source and said electrode in a respective one of said electrode holders, for ensuring electrical connection and stable contacting.

3. The spray atomizer according to claim 1, wherein said cascaded high-voltage source for feeding said electrode in each of said electrode holders is a cascade configuration of diodes and capacitors serving as a voltage amplifier.

4. The spray atomizer according to claim 1, wherein said at least two electrode holders are six electrode holders disposed at regular intervals around said housing, and said ends of said electrode holders are front ends each having a tip receiving a respective one of said electrodes.

5. The spray atomizer according to claim 1, wherein each of said electrode holders has a given diameter, and each of said electrode holders is disposed at a radial distance from said housing corresponding at most to said given diameter.

6. The spray atomizer according to claim 1, wherein each of said electrode holders has a given diameter, and each of said electrode holders has a length corresponding to at least five times said given diameter.

7. The spray atomizer according to claim 1, including a concentric ring surrounding said housing, said electrode holders disposed on said concentric ring.

8. The spray atomizer according to claim 1, including holding arms attached radially to said housing, said electrode holders each disposed on a respective one of said holding arms.

9. The spray atomizer according to claim 1, wherein said drive motor is a turbine having a turbine casing at floating potential, and current commutation takes place outside said turbine through electrodes.

10. The spray atomizer according to claim 1, wherein said drive motor is a turbine having a turbine casing at floating potential, and current commutation takes place outside said turbine through a ring.

* * * * *